US005119973A

United States Patent [19]

Miller et al.

[11] Patent Number: 5,119,973

[45] Date of Patent: Jun. 9, 1992

[54] AUTOMATED DISPENSING APPARATUS

[75] Inventors: William Miller, Buffalo Grove, Ill.; Leen Hellenberg, Holland, Netherlands

[73] Assignee: Fluid Management Limited Partnership, Wheeling, Ill.

[21] Appl. No.: 628,228

[22] Filed: Dec. 14, 1990

[51] Int. Cl.[5] ..... B67D 5/60

[52] U.S. Cl. ..... 222/144; 141/104; 222/135; 222/144.5

[58] Field of Search ..... 222/135, 144, 144.5, 222/309, 380, 504; 141/103, 104, 284

[56] References Cited

U.S. PATENT DOCUMENTS

| | | | |
|---|---|---|---|
| 2,158,774 | 5/1939 | Grubelic | 222/144 X |
| 2,848,019 | 8/1958 | Corbin et al. | 222/144 X |
| 3,029,847 | 4/1962 | Baudhuin et al. | 222/144 X |
| 3,074,597 | 1/1963 | Felts | 222/144 X |
| 3,097,763 | 7/1963 | Alvotto | 222/135 X |
| 3,122,272 | 2/1964 | Marsh | 222/144 X |
| 4,027,785 | 6/1977 | Edstrom et al. | 222/309 X |
| 4,046,287 | 9/1977 | Hoekstra et al. | 222/309 X |
| 4,254,806 | 3/1981 | Elsworth | 222/380 X |
| 4,681,741 | 7/1987 | Hanaway | 222/144 |
| 4,967,938 | 11/1990 | Hellenberg | 222/144 |

*Primary Examiner*—Donald T. Hajec

*Attorney, Agent, or Firm*—Fitch, Even, Tabin & Flannery

[57] ABSTRACT

Dispenser actuating apparatus includes guide rails carrying a valve actuator at one end. A pump actuator is mounted for sliding along the guide rails, and the guide rails are mounted for sliding along their central axes. Separate motors and drive belts reciprocate the valve and pump actuators with independent movements.

16 Claims, 5 Drawing Sheets

AUTOMATED DISPENSING APPARATUS

BACKGROUND OF THE INVENTION:

1. Field of the Invention:

This invention relates to apparatus for dispensing liquid and pulverulent materials,, and more particularly, to such apparatus which is suitable for an automated paint dispensing operation.

2. Description of the Related Art:

To avoid having to separately inventory different color paints, many paint retailers use a common paint base that is individually tinted with a colorant on a per-order basis. It is known to provide a turntable supporting a plurality of containers holding colorant which is stored therein in liquid form. Metering structure is provided to dispense measured amounts of colorant from the containers into the paint base.

A merchandiser of paint materials may find it convenient to limit the major portion of paint inventory to a paint base material, which can be tinted or otherwise colored to produce a wide variety of colored paint materials. Thus, a merchandiser need not estimate beforehand the quantity of a given color paint that should be maintained in stock. While the above-mentioned colorant dispensing apparatus can be relied upon to accurately meter even small amounts of colorants required for a given paint formulation, the colorant materials are frequently discharged through a downwardly extending conduit or nozzle which extends below a shut-off valve. Such nozzles have been observed to become clogged with colorant materials which thereafter harden, upon drying. The assignee of the present invention has made significant improvements in automated, i.e., automatic and semi-automatic paint dispensing apparatus. For example, United States Patent application Ser. No. 380,974, filed Jul. 17, 1989 and United States patent application Ser. No. 485,251, filed Feb. 26, 1990 disclose a turntable carrying a plurality of colorant canisters disposed about the turntable periphery. Pump and valve apparatus associated with each canister are operated with actuator mechanisms carried on the turntable and located radially interiorly of the series of colorant canisters. The mechanisms include belt-driven brackets which engage the pump and valve apparatus of a particular canister. The actuator mechanisms comprise separate sub-assemblies located at a colorant dispensing station on the turntable. Further details concerning the construction and operation are given in the aforementioned United States Patent application Ser. Nos. 380,974, now U.S. Pat. No. 4,907,938, and 485,251, now U.S. Pat. No. 5,078,302, the disclosure of which is incorporated in this application as if fully set forth herein.

Despite the ready acceptance and commercial success of the paint dispensing apparatus described above, further improvements were sought. For example, the actuating mechanism, as well as flexible cable drives for stirrers associated with each colorant canister are located at the radial interior portion of the turntable, being contained within an encircling array of colorant canisters. Routine maintenance and cleaning operations could be improved if the actuating mechanisms were made more readily accessible to service personnel.

Further advantages were sought to simplify the belt path for the actuating mechanisms and to improve the ready alignment of those mechanisms with the turntable and the canister array.

SUMMARY OF THE INVENTION

It is an object of the present invention to provide a dispensing machine, including such machines which are suitable for semi-automatic or fully automatic operation under the control, for example, of a microcomputer.

Another object according to the present invention is to provide a dispensing machine of the above-described type having an improved construction to provide ready access to the actuating mechanism employed.

A further object according to the present invention is to provide dispensing machines of the above-described type having an improved reliability with an improved drive belt arrangement.

These and other objects according to the present invention, which will become apparent from the studying of the appended description and accompanying drawings are provided in a dispenser actuating apparatus for actuating a dispenser pump and a shut off valve of an automated dispensing machine, the apparatus comprising:

- a support structure;
- elongated guide rail means having a longitudinal axis and a first end;
- guide rail mounting means for slidably mounting the guide rail means on the support structure for movement along the longitudinal axis of the guide rail means;
- valve engaging means carried at the first end of the guide rail means;
- means for securing the valve engaging means to the guide rail means;
- a drive block for axially displacing the guide rail means;
- means for fixedly attaching the drive block to the guide rail means;
- a pump engaging means for actuating a pump of the dispenser machine;
- means for slidably mounting the pump engaging means on the guide rail means for sliding movement therealong;
- means for moving the drive block in opposite directions generally parallel to the axis of the guide rail means to thereby reciprocate the guide rail means and the valve engaging means carried thereon for valve actuating movement without displacing the pump engaging means; and
- means for moving the pump engaging means in opposite directions along the guide rail means to thereby reciprocate the pump engaging means for pump actuating movement without displacing the valve engaging means.

BRIEF DESCRIPTION OF THE DRAWINGS

In the drawings, wherein like elements are referenced alike.

DETAILED DESCRIPTION OF THE PREFERRED EMBODIMENT

Figure 1:
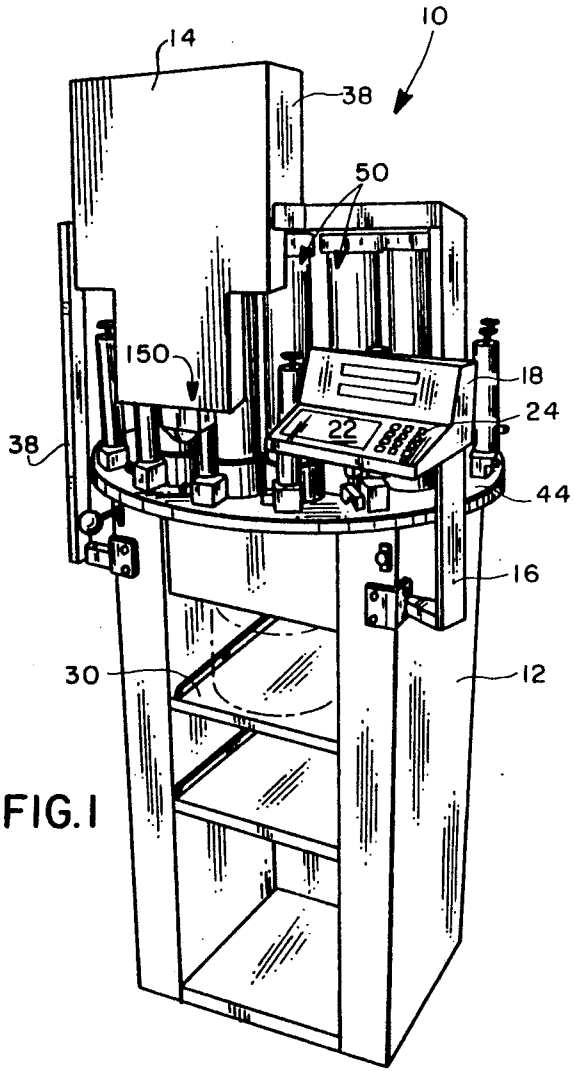
FIG. 1 is a perspective view of a paint colorant and dispensing apparatus constructed according to principles of the present invention.

Referring now to the drawings and initially to FIG. 1, a fully automated metering and dispensing apparatus is generally indicated at 10. The apparatus 10 includes a support structure or lower housing 12 and an upper housing 14 mounted thereon. Housing 12 includes a mounting arm 16 on which a computer 18 or other digital control apparatus is mounted. The computer 18 includes a cathode ray tube (CRT) display monitor 22 and a keyboard 24.

Figure 2:
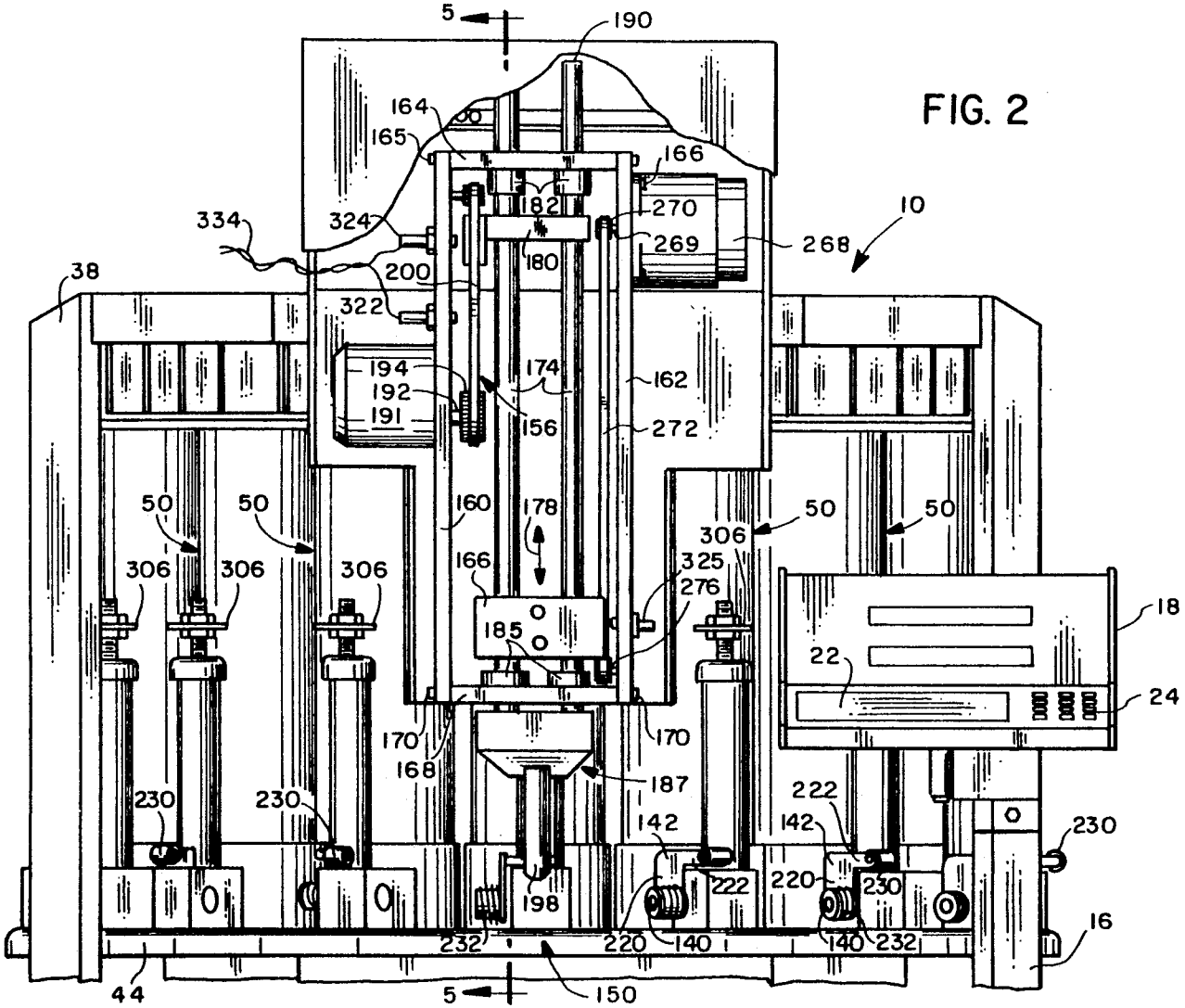
FIG. 2 is a fragmentary elevational view of the apparatus of FIG. 1, shown with the outer cover removed.

The upper end of housing 14 includes a lid or cover 38, shown partly broken away in FIG. 2. The cover is supported by framework 38 mounted on housing 12.

Apparatus 10 further includes a platform 30 which is slidable in horizontal directions along tracks, not shown. As will be seen herein, paint colorant is selected, metered, and dispensed beneath housing 14 so as to drop into the open, upper end of a paint container.

Referring to FIG. 2, the paint colorant and dispensing apparatus 10 includes a plurality of colorant dispenser assemblies 50 disposed about turntable 44. The turntable is supported at its central portion for rotation with respect to housing 12. According to one aspect of the present invention, the colorant container assemblies are disposed about the outer periphery of turntable 44 so as to be moveable into engagement with actuating mechanisms in housing 14, upon rotation of the turntable. In the preferred embodiment, sixteen colorant containers are provided for the apparatus 10, although the apparatus could be readily adapted to accommodate a different number of containers, if desired.

Figure 4:
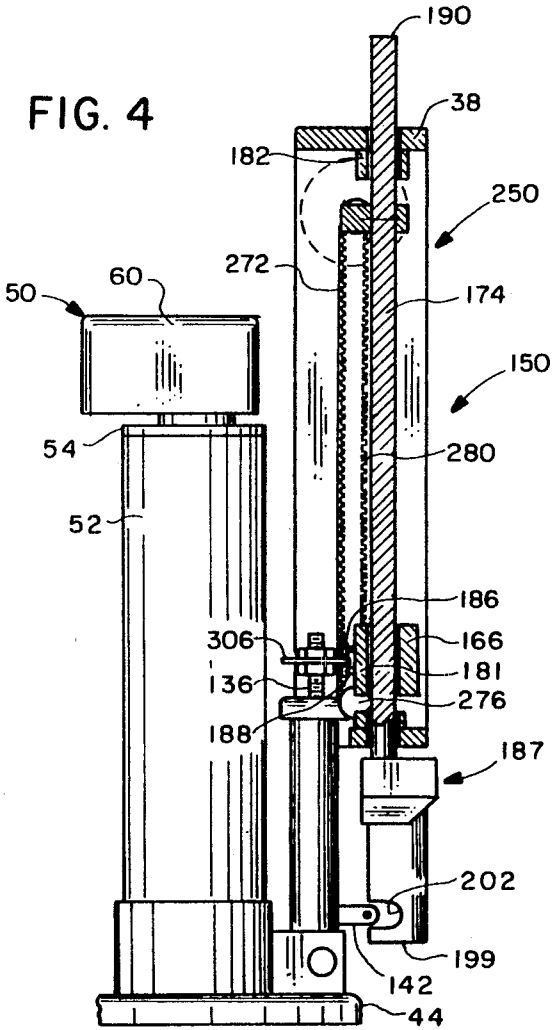
FIG. 4 is a fragmentary side elevational view of the apparatus of the preceding figures, shown partly in cross-section.
Figure 3:
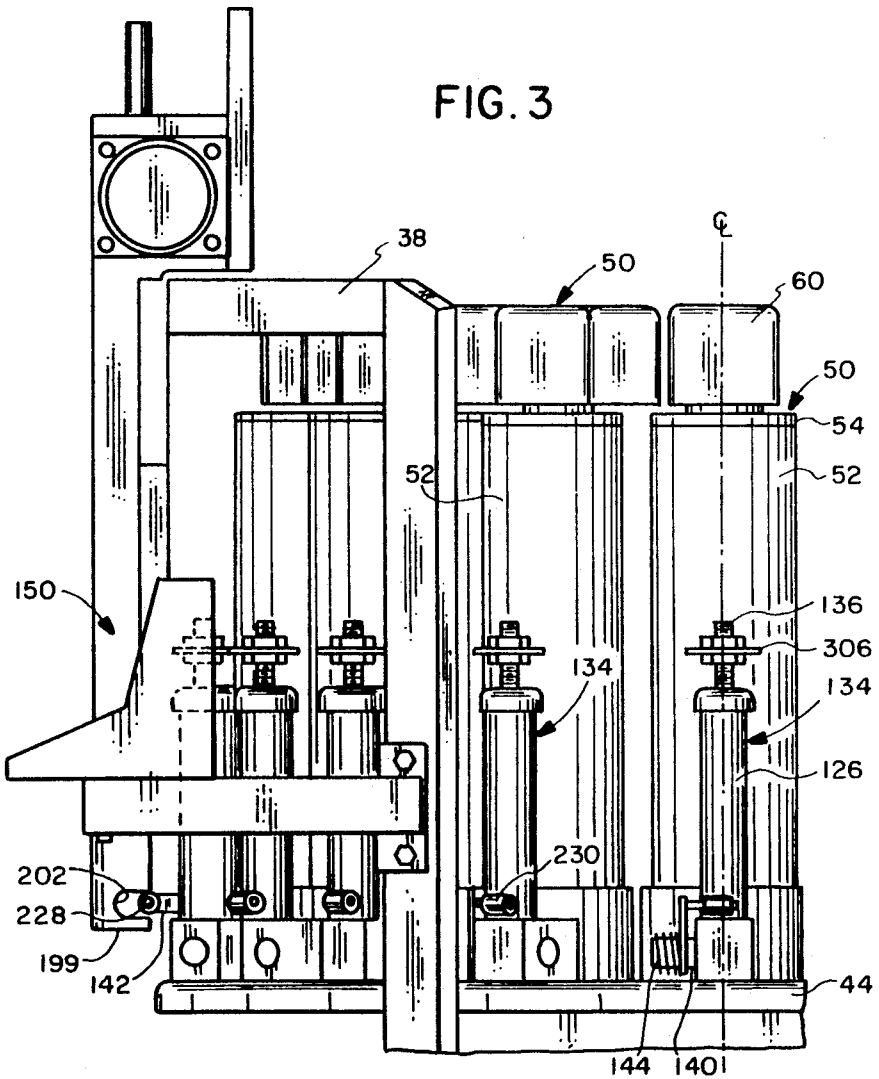
FIG. 3 is a fragmentary elevational view of the apparatus.

The paint colorant dispenser assemblies 50 include a generally cylindrical container 52 having an upper, open end enclosed by a lid 54 (see FIGS. 3 and 4). Disposed within each container is an agitator (not shown) immersed within a colorant liquid within containers 52. The agitators are driven by any suitable means such as the mechanisms in housings 60 mounted atop each canister container.

Turning to FIGS. 4–5 and 9–10, a colorant dispenser assembly 50 is illustrated as having the aforementioned container 52 for storing a quantity of liquid coloring material. The container 52 is mounted at its lower end to a flow control valve 130 which includes a valve housing 132 located at the base of container 52. The valve housing 132 includes a passageway communicating with the interior of the container 52 to permit flow of a colorant material to a pump generally indicated at 134. The pump is attached at its lower end to valve housing 132 and defines a metering or pumping chamber 126 in which a piston reciprocates. A pump rod 136 extends above the pumping chamber and is secured to a piston, not shown in the figures, disposed within the pumping chamber.

As the rod is raised, a suction is applied by the piston to withdraw colorant material from container 52, through passageways within base 132. A valve located in the base blocks the outflow from container 52, as well as the discharge of material from the pumping chamber. A shaft 140 is attached to the valve and when rotated, opens and closes the valve. A crank arm 142 is attached to one end of shaft 140 and a spring 144 biases the shaft for rotation in a direction which closes the valve. With continuous rotation of the valve in a given direction, a first portion of the valve opens to permit flow from the storage container 52 to the pumping chamber, while blocking the outlet of the pumping chamber. Upon further rotation, the container 52 is blocked, and a second portion of the valve is opened to permit a discharge of colorant material through a nozzle or other discharge structure into a bucket of paint base material disposed beneath the turntable 44. Further details concerning the construction and operation of the valve housing 132, the pump 134 and the internal valve are provided in U. S. Pat. No. 4,027,785 which is herein incorporated by reference. As can now be seen, the dispensing of a metered quantity of colorant material is provided by the sequential operation of the crank arm 142 of the valve mechanism and the pump rod 136 of the pump mechanism in the manner described in the aforementioned U.S. Pat. No. 4,027,785.

Referring now to FIG. 2, a dispenser actuating means is located at as dispensing station 150, located at the front of apparatus 10, adjacent the path of travel of colorant containers carried on turntable 44. The dispenser actuating means delivers metered amounts of colorant materials in the various containers to a container of paint base material, such as the aforementioned bucket 46, located beneath turntable 44. As will be seen, the dispenser actuating means includes an actuating mechanism for actuating the metering pump 134, and an actuating mechanism for actuating the valve internal to valve housing 132, all of which can be readily automated along with indexing of turntable 44, being carried out under instructions from a digital control unit such as the aforementioned digital computer 18. In the preferred embodiment, the turntable is manually indexed, but sensing apparatus is provided to notify the computer 18 that a colorant dispenser assembly 50 is positioned at the dispensing station 150.

Figure 5:
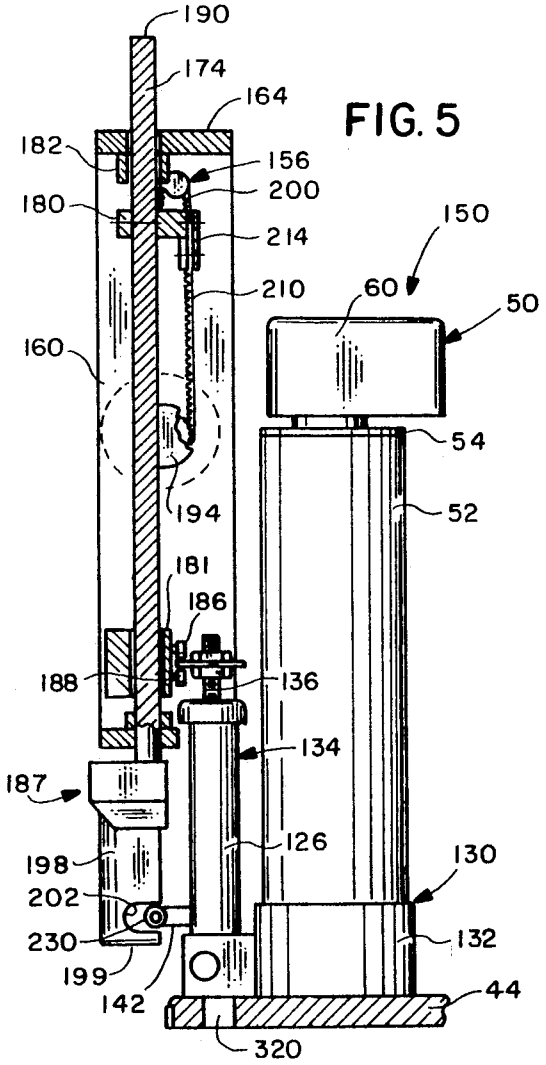
FIG. 5 is a fragmentary side elevational view of the opposing side of the apparatus of FIG. 4, shown partly in cross-section.

Turning now to FIGS. 2–5, a valve actuating mechanism is generally indicated at 156. The mechanism is supported by the aforementioned framework structure 38 and with reference to FIG. 2, includes frame sidewalls 160, 162. A header block 164 of the frame is attached by bolt fasteners 165 to the upper ends of sidewalls 160, 162. A footer or lower support 168 of the frame is secured to the lower ends of sidewalls 160, 162 by bolt fasteners 170. A pair of elongated preferably cylindrical guide rails 174 have their opposed ends mounted in the header and footer members 164, 168. A first drive block or travelling head 166, used for pump actuation, is slidably mounted on guide rails 174 for reciprocating travel in the vertical directions indicated by arrow 178. Referring to FIG. 5, a pump engaging means or bracket 181 is secured to travelling head 166 by bolt fasteners. The bracket 181 has a slot or recess 300 formed therein by a pair of opposed upper and lower roller members 186, 188.

A second drive block or travelling head 180 is fixedly mounted to cylindrical guide rods 164, 168 which reciprocate in the directions of arrow 178. As will be explained herein, the cylindrical guide rails 174 are free to move in vertical directions, being slidably mounted in bushings 182 which are secured to header block 164 and bushings 185 which are secured to footer block 168.(see FIG. 2) The lower ends of guide rods 174 are secured to a valve engaging means or bracket assembly 187. The upper free ends 190 of the guide rods extend varying amounts above header block 164, as can be seen with reference to FIGS. 6–8. The travelling head 180 is secured to guide rods 174 with set screws, not shown, and move the guide rods back and forth in vertical directions. The header block 166 has bearings mounted therein so as to be slidable along the guide bars.

Figure 9:
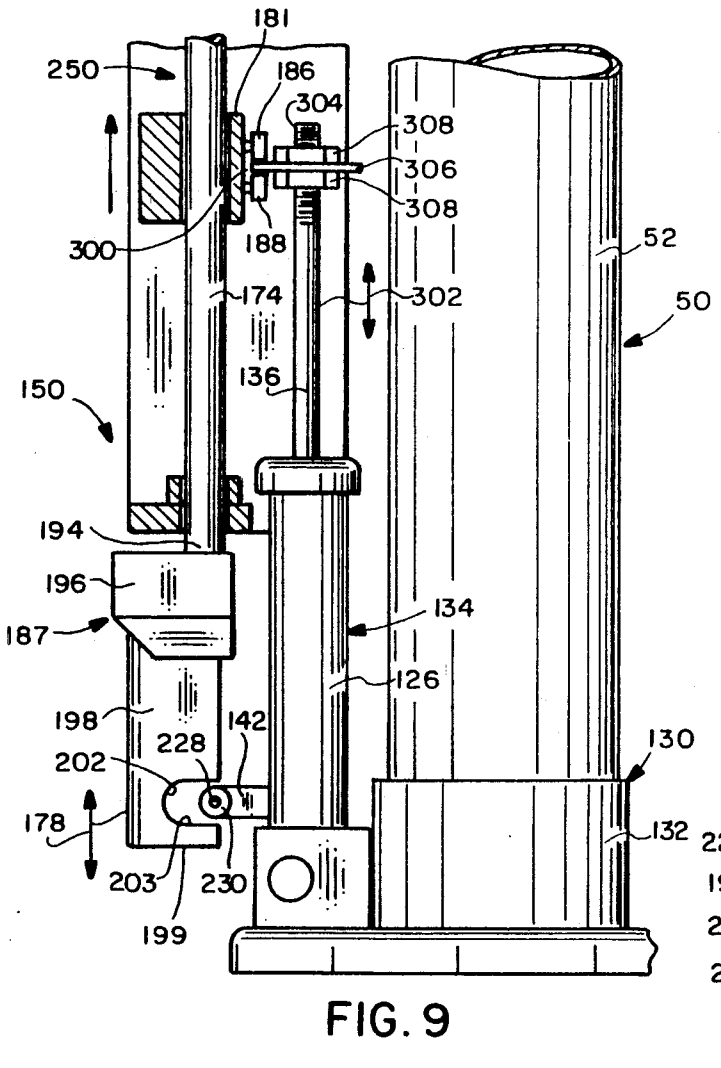

With reference to FIGS. 2 and 9, for example, the lower ends 194 of guide rods 174 are secured to a mounting block 196 of bracket assembly 187 using conventional means. A valve-actuating bracket 198 is secured at its upper end to mounting block 196. The bracket 198 has a lower free end 199 and a rearward-opening slot 202.

A valve actuating motor 191 is mounted to the sidewall 160 and is oriented so that output shaft 192 thereof extends in a forward, generally horizontal direction. A drive gear 194 is mounted to motor shaft 192 and has an outer toothed surface for engagement with a cog belt 200. With brief reference to FIG. 5, the cog belt 200 follows a generally oval-shaped path, with the rear leg of the oval path extending in a generally vertical direction. Belt 200 is wound about an idler roller 206, in addition to the drive gear 194. The idler roller 206 is also mounted to sidewall 160 and the idler roller 206 is rearwardly displaced with respect to the larger diameter drive gear 194, so that the vertical segment portion 210 of belt 200, spanning the distance between idler roller 206 and gear 194 extends in a generally vertical direction. As will now be appreciated, the mounting holes for the drive gear and idler roller defining the path of travel of belt 200 are formed in the same sidewall, thus simplifying and improving the reliability of the alignment of these components.

Referring now to FIG. 5, the valve actuating mechanism 156 is illustrated in a cross-sectional view taken along the left-hand guide rail of FIG. 2. The vertical segment 210 of drive belt 200 is clamped between travelling head 180 and a clamping piece 214, which are secured together by threaded fasteners. In the preferred embodiment, valve actuating motor 191 is a stepping motor, which is rotatable in opposing directions so as to be able to move the clamped segment 210 of drive belt 200 in upward and downward vertical directions.

Accordingly, the travelling head 180, the guide rails 174 and the slotted bracket 198 attached thereto can be displaced in precise amounts in vertically upward and downward directions. FIG. 9 shows the crank arm 142 in a raised position, which closes the flow control valve in valve housing 132. When opening of the valve is desired, motor 191 is energized so as to move the belt portion 210 in a downward direction, thereby lowering the slotted bracket, and thus the crank arm 142, to the position indicated in FIG. 10, whereby the flow control valve within valve hosing 132 is moved to an open position for dispensing of colorant material.

Figure 6:
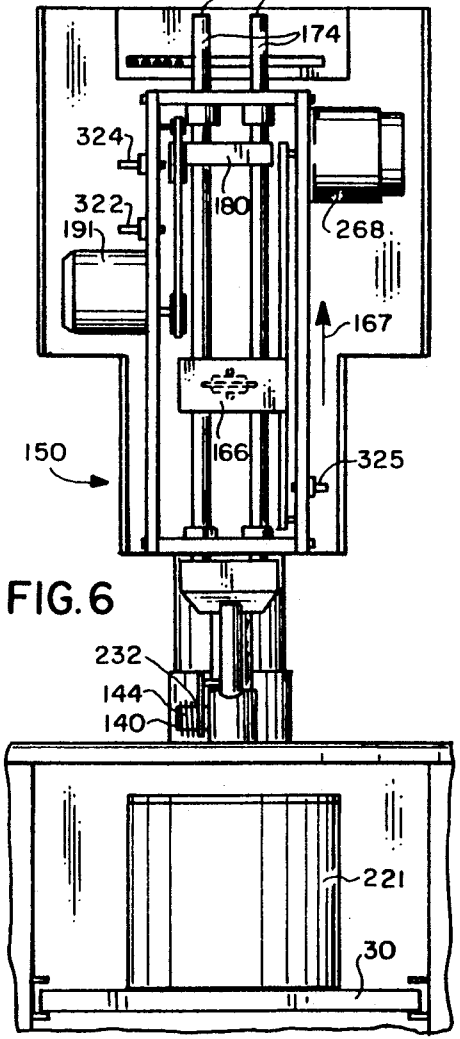
Figure 10:
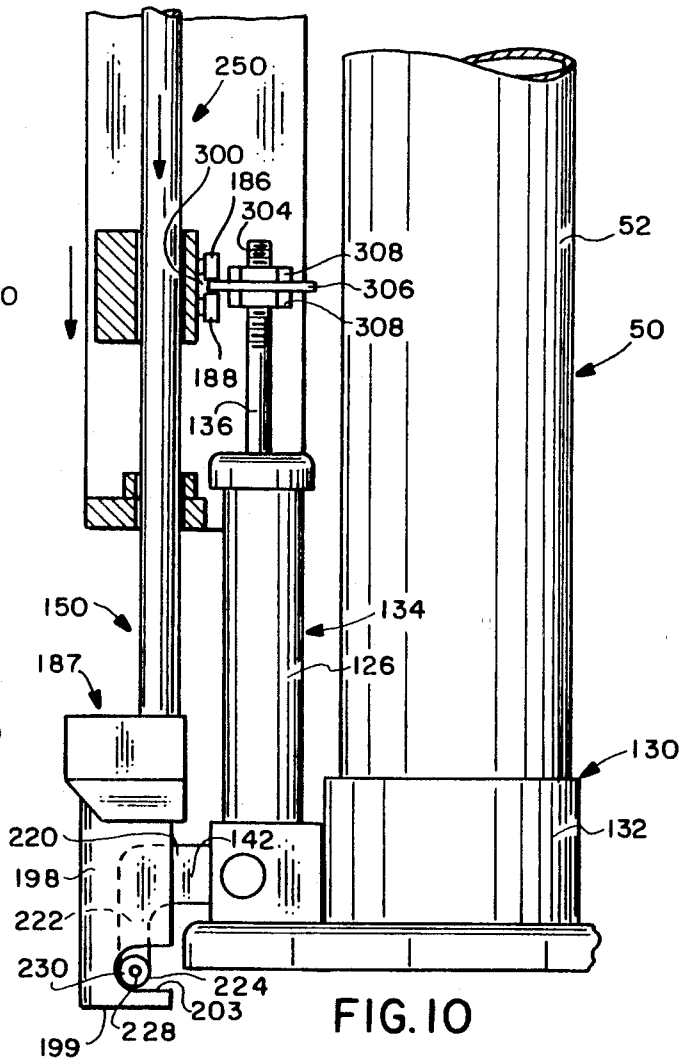
FIGS. 9 and 10 are fragmentary side elevational views, showing the sequence of operation of the valve mechanism from a different vantage point.

Referring now to FIG. 10, and the lower, right-hand portion of FIG. 2, the crank arm 142 can be seen to have a generally L-shaped configuration with a first leg 220 overlying the axis of valve shaft 140, and a second leg 222 which, when the valve is in a closed position, extends in a horizontal direction, radially disposed with respect to the turntable. The second leg 222 has a rounded free end 224 in which an aperture is formed to receive the shaft 228 of a roller 230. With reference to FIG. 6, collar 232 extends from the crank arm 142 and has an inner bore for receiving the valve shaft 140. An aperture is formed in the collar to receive a hook-shaped free end of spring 144, so that, when installed, the spring 144 surrounds the collar 232 and is generally concentric therewith. The second end of spring 144 engages an edge of crank arm leg 220. The collar 232 is moveable with respect to crank arm 142, and leg 220 of the crank arm has a keyed aperture for receiving the valve shaft 140 for keyed engagement therewith.

Thus, as the crank arm 142 is rotated to the lowered valve-opening position of FIG. 10, the coils of spring 144 are tightened, storing a bias force for returning the crank arm to the closed valve position illustrated in FIG. 9. With reference to FIG. 5, a series of generally rectangular openings 320 are formed in turntable 44, with one opening adjacent each container assembly. The openings 320 allow mounting of the colorant dispenser assemblies above the turntable. When the valve is in an open position of FIG. 10, the crank arm leg 222 overhangs the turntable edge.

Although, as has been seen above, the angle bracket 181 is moveable in vertical directions, it is preferred that the angle bracket be fixed with respect to movement in other directions, thus simplifying the design of the angle bracket and the associated mechanism for actuating that bracket, while reducing the risk of inaccuracies when repetitively operating the crank arms of the several colorant containers. As mentioned above, the valve construction and operation follow the principles disclosed in U.S. Pat. No. 4,027,785. Due to the multiple porting of the valve shaft and the close tolerance angular displacement of that porting, the valve actuating mechanism must be capable of fairly accurate rotational displacement of the valve shaft to insure proper operation of the dispensing valve. Also, it is desirable to operate the sealing valve with the same actuating bracket. The various features of the valve actuating mechanism 156 achieve these benefits.

As will be seen below, these same principles of limited movement of the pump actuating mechanism along a highly accurate repeatable path of actuation, coupled with an ability to clear the interengaging projections of rotating container assemblies are also found in the metering apparatus.

Referring again to FIGS. 4, 9 and 10, a mechanism for actuating the metering pumps of the various colorant containers is generally indicated at 250. As will be seen, the pump actuator mechanism 250 has certain similarities to the valve actuating mechanism 156 described above. For example, the travelling head 166 is mounted on guide rails 174 for sliding reciprocation therealong in vertical directions, indicated by the double headed arrow 178.

A pump drive motor 268 is attached to sidewall 162 and is oriented to have a generally horizontal, forwardly extending output shaft 269. A drive gear 270 is secured to the motor output shaft 269 for rotation therewith, and has teeth on its outer surface for meshing with a cog belt 272. With reference to FIG. 4, the cog belt 272 has a simplified "racetrack" configuration, being supported at one end by the aforementioned drive gear 270, and being supported by the remaining end by idler roller 276. The upper drive gear 270 and the lower drive roller 276 are disposed one above the other so that the section 280 of cog belt 272 suspended therebetween extends in a generally vertical direction. Drive motor 268 is preferably of the stepper motor type, being capable of controlled operation in opposing directions of rotation. Thus, in operation, the drive motor 268 can be stepped in response to electrical control signals to move the vertical section 280 of cog belt 272 in defined vertical increments.

Referring again to FIG. 4, the bracket 181 extends rearwardly from travelling head 166 and is positioned to contact a surface of cog belt section 280. A clamping member is placed over an opposing surface of the cog belt and is secured to bracket 181 with a suitable fastener. Thus, the travelling head 166 is clamped to the cog belt section 280 for travel therewith in reciprocating vertical directions.

Referring to FIG. 9, the travelling head 166 is illustrated in a raised position. Rotation of the output shaft of motor 268 will cause the cog belt section 280, and the travelling head 166 secured thereto, to travel in a downward direction, to a lowered position, such as that illustrated in FIG. 4.

Upper and lower rollers 186, 188 are secured to travelling head 166 by shafts as can be seen in FIGS. 9 and 10. The rollers 186, 188 are mounted for rotation about generally horizontal, radially extending axes. In the preferred embodiment, the axes of rotation of the rollers 186, 188 are disposed one above the other. As indicated in FIGS. 9 and 10, the rollers 186, 188 are preferably spaced apart a small distance so as, to form the recess 184. The metering pump 134 includes the pump rod 136 mounted to a piston disposed within a cylindrical pump housing 126. The lower end of pump housing 126 is joined to Valve housing 132 and the valve 130 is operable to block the discharge from the pump, and to also control its intake of liquid colorant material from the container 52.

Referring again to FIGS. 9 and 10, the pump 134 has a piston-connected shaft or rod 136 which is moveable in vertical directions indicated by the double-headed arrow 302. The upper, free end 304 of rod 136 receives a washer 306 which is secured thereto by threaded fasteners 308. In the preferred embodiment, the washer 306 is oriented generally perpendicular to the vertical axis of rod 136 so as to present a minimum profile to the opening 300 between rollers 186, 188. As turntable 44 is rotated in the opposing directions, the washers 306 associated with the colorant dispenser assemblies 50 are moved past the dispensing station 150, being passed through the opening 300 formed between rollers 186, 188.

In the preferred operation of the colorant and dispensing apparatus 10, the travelling head 166 of the pump actuating mechanism 250 is in the lowered position indicated in FIG. 5 and the pump rods 136 of the colorant dispenser assembly 50 are in the indicated lower or retracted position aligned with the opening 300 between rollers 186, 188. As will now be appreciated, as the washers 306 of the various colorant dispenser assemblies are passed between rollers 186, 188, the washer and rollers present curved, generally circular surfaces to he opening 300 which reduces the risk of binding as the initial areas of nipping engagement are very small, and are gradually increased at a steady rate. As with the slotted bracket for the valve actuating mechanism, the space between rollers 186, 188 is part of a continuous opening which lies in a horizontal plane passing through opening 300 thus allowing free, unobstructed passage of the protruding washers carried on the plurality of colorant dispenser assemblies.

The operation of pump actuating mechanism 250 has many of the same advantages as described above with reference to the valve actuating mechanism 156. For example, the pump actuating mechanism has a recess 300 of fixed dimension, being defined by a pair of fixedly spaced-apart guide surfaces, herein the outer surfaces of rollers 186, 188. Further, the guide rollers 186, 188 are constrained for movement in vertical directions. If desired, the bracket 181 carrying the rollers 186, 188 could be mounted for rotation or radially inward translation away from the path of passing washers 306, but such is generally not preferred.

Accordingly, it is required that the washers of colorant container assemblies passing through the dispensing station be received in an opening 300 between the rollers 186, 188, the locations of which are fixed in space. Additional advantages are provided by the rollers 186, 188 in that the rollers are mounted for rotation about their central axes, corresponding to the direction of forces imparted thereto by moving washers 306, should contact therebetween be experienced. Further, in the unlikely event that a washer 306 of a particular colorant container assembly should be slightly displaced during operation of apparatus 10, or during servicing procedure, for example, the rollers 186, 188 with a minimum of disturbance, will guide the washer 306 to a very accurately defined height above turntable 44.

As can be seen from the above, the valve actuating mechanism 156 and the pump actuating mechanism 250 can be readily adapted for use with digital and other electronic control systems for automated, i.e. , semi-automatic or fully automatic operation. One advantage of a metering and dispensing apparatus constructed according to principles of the present invention, is that the actuating mechanisms can be economically constructed from a minimum number of inexpensive parts, thereby avoiding the higher costs of construction and maintenance commonly associated with automated mechanisms which must repeatedly operate with accurate, well defined movements.

In the preferred embodiment of a metering and dispensing apparatus according to the present invention, a programmable computer 18 is provided 12 for the semi-automatic operation of apparatus 10. However, if desired, the actuating mechanisms and related features of the metering and dispensing apparatus can be fully automated under the control of programmable or non-programmable electrical systems. For example, the programmable computer 18 can be replaced by one or more feedback control circuits, either of the closed loop or open loop type. However, the programmable computer is preferred for the semi-automated control of apparatus 10 since, as will be appreciated by those skilled in the art, changes in a family of paint colors often requires numerous adjustments to the various paint formulations associated with that color family. With the programmable computer, families of color formulations can easily be entered through keyboard 24, or through magnetic storage media which can be read into and stored in the electronic memory within computer 18. The CRT Monitor 22 provides an easy means of locating a paint formulation stored in the computer for use on demand, as when it is desired to color a given quantity of paint base material to obtain a paint product of a specified color.

In a semi-automated paint coloring operation, the turntable 44 is indexed manually according to operator instructions appearing in the monitor 22, to present a series of selected paint colorant assemblies to dispensing station 150. Given a particular color family of paint colors, formulations for each color are stored in computer 18. The formulations for particular colors will specify the particular colorant and the amount of such colorant to be dispensed in the container of paint base material. This is accomplished by identifying a particular position on turntable 44 for the colorant container assembly holding the desired liquid colorant material. The formulation for each selected colorant material will also specify the amount of such material to be dispensed at the dispensing station 150. Each portion of the paint formulation process is initiated with a display of the turntable position required. After the turntable is manually indexed by the operator, the computer 18 outputs valve actuation signals and metering pump actuation signals which displace the bracket 181 holding rollers 186, 188 prescribed amounts to accomplish the metered dispensing of a colorant from a particular colorant container assembly presented to the dispensing station 150.

More particularly, the meter actuation signals cause the pump motor 268 to displace the travelling head 166 a carefully prescribed amount so as to raise washer 306, and hence the piston within pumping chamber 134, a carefully controlled distance so as to withdraw an accurate amount of liquid colorant material through valve housing 132 into the pumping chamber. Thereafter, the valve actuating motor 191 receives valve actuation control signals from computer 18 which cause the travelling head 180 to descend, thereby rotating valve shaft 140 in desired sequence of steps which first introduces a port between the container 52 and pump housing 134 to permit the withdrawal of colorant material.

Upon completion of the metered withdrawal, the valve actuating motor is further rotated to present another port which allows dispensing of the metered colorant temporarily stored in pump housing 134, as travelling head 166 is lowered to its rest position, thereby forcing the metered colorant from the discharge outlet of the metering or pump chamber.

As illustrated in FIGS. 9 and 10, the slot 202 in bracket 198 is considerably larger than roller 230. As the slotted bracket 198 is lowered, it applies pressure to the crank arm 142 and the engagement with the crank arm comprises a low friction rolling motion. When a dispensing operation has been completed and closure of valve 130 is desired, the direction of rotation of drive motor 191 is reversed so as to raise slotted bracket 198. Due to the spring bias return applied to shaft 140, engagement of roller 230 with the upper surface defining slot 202 is maintained. Thus, if desired, the lower surface 203 defining slot 202 and the material of bracket 198 therebelow could be removed. However, it is desirable to maintain the lower portion of bracket 198, that portion below the roller, so as to insure a foolproof return of the valve shaft to its closed position.

As mentioned above, a fully automated paint metering and dispensing apparatus requires indexing means for indexing the turntable 44 so as to present one or more preselected colorant container assemblies to the dispensing station 150. For example, the indexing means could include a rotatable driven support shaft. It is important that the rotatable drive be able to determine when a particular colorant container assembly is precisely located at the dispensing station 150. The indexing means should also be capable of tracking the locations of the various colorant container assemblies.

A pair of sensors, preferably optical sensors are provided for collecting data from which the location of the valve actuating head 180 can be adduced. The optical sensors are illustrated in FIGS. 2, and 6–8, and are indicated by reference numerals 322, 324. The sensors are mounted in sidewall 160. The sensors 322, 324 may comprise a transmitter/receiver pair, or each sensor may include both transmitting and receiving elements. With reference to FIG. 2, electrical leads 334 from the sensors are coupled at their remote ends to computer 18. The signals from sensors 322, 324 are fed into computer 18 along conductors 134 to provide a feedback signal to the valve actuator turntable rotation drive which is also controlled by computer 18. Any number of conventional control circuit designs can be used to index turntable 44 so as to accurately position a particular colorant container assembly at dispensing station 150.

Operation of the metering and dispensing apparatus is initiated with the entry of a desired paint color and quantity size which is entered into computer 18 via terminal 24. The computer matches the paint name or code to a formulation stored either in its memory, or on a floppy disk or the like magnetic storage media. The paint formulation specifies the colorants used in the particular formula, and the amount of colorant required, depending upon the container size indicated.

According to one aspect of the present invention, the computer may be employed to identify and remember the present location of the turntable, which can be indicated by any suitable means. The computer could then calculate and identify the closest container assembly called for in the formula, assisting the operator in bringing the identified colorant assembly to the dispensing station in the shortest possible time.

As the container assembly approaches the dispensing station, the roller 230 associated with the container assembly valve, and the washer 306 also associated with the corresponding pump actuating mechanism, the assembly engage the bracket 181 and the washer associated with the assembly enters the nip between idler rollers 186, 188. Any suitable interlock could be provided to ensure that a colorant assembly is properly oriented at the dispensing station. Next, the computer sends a valve actuation signal to the stepper motor 90 which rotates a preselected amount necessary to rotate the flow control valve shaft 140 to a first incremental position whereby an internal passageway is cleared for withdrawal of the colorant material by pump 134. Thereafter, the computer sends a meter actuation signal to stepper motor 268 which raises the washer 306, and hence the pump rod 136 connected thereto, a predetermined height by which a quantity of colorant extracted from container 52 is metered to within close tolerance limits according to the programmed paint formulation. When the upstroke of the pump rod 136 is completed the stepper motor 191 is again activated to further rotate flow control valve shaft 140, thereby isolating the pump 134 from container 52, an opening a passageway though which the contents of the pump can be discharged into a paint bucket or the like receptacle disposed on platform 30.

Meter actuating signals to stepper motor 191 are timed with respect to signals to stepper motor 268, so as to coordinate vertical translation of the pump rods 136 and bracket 198, with the flow control valve 130 at the proper time so as to allow free flow of colorant from the pump assembly. Downward movement of bracket 198 engages rollers 230 attached to the legs 222 of the flow control valve crank arm 142, thereby rotating the flow control valve shaft 140 toward its fully open discharge position.

Further meter actuation signals are then sent to stepper motor 268 to lower the washer 306 to the rest position illustrated in FIG. 4, for example. A sensor 325 is mounted in sidewall 162 to detect the fully discharged pump condition illustrated in FIGS. 2 and 8, for example, when the pump rod 136 is fully retracted within pump housing 134. Upon discharge of the metered colorant in pump 134, additional valve actuation signals are sent to stepper motor 191 so as to raise the bracket 181, thereby allowing flow control valve to close, with shaft 140 rotating in a counterclockwise direction under the force of the coil spring. Alternatively, the slotted bracket 198 can be raised to engage the idler roller 230 so as to force the crank arm associated with the valve to a fully closed position, such as that illustrated in FIG. 9. The computer keeps track of the colorants which have been dispensed, and reviews the point formulation to see if additional colorants are needed. If they are, the next colorant dispenser is displayed for the operator. Optionally, the turntable could be scanned for the location of the closest container assembly holding colorant which is required by the formulation. The indexing, metering and dispensing steps are repeated as many times as are required until all colorants required by the formulation have been dispensed.

As can be seen from the above, the travelling heads for the valve actuation and pump actuation can undergo independent movement, even though they share a common pair of cylindrical guide rails, thus reducing the number of components required and simplifying the alignment and setup procedures. Further, the guide rails reciprocate or travel along with movement of travelling head 180, which is driven by movement of cog belt 200. According to the present invention, the guide rails can be displaced independent of movement of pump actuating head 166 which is moved along guide rails 174 independent of displacement of the guide rails and which is braked by cog belt 272 as desired for fixed, stationary placement of travelling head 166, despite movement of guide rails 174.

Figure 8:
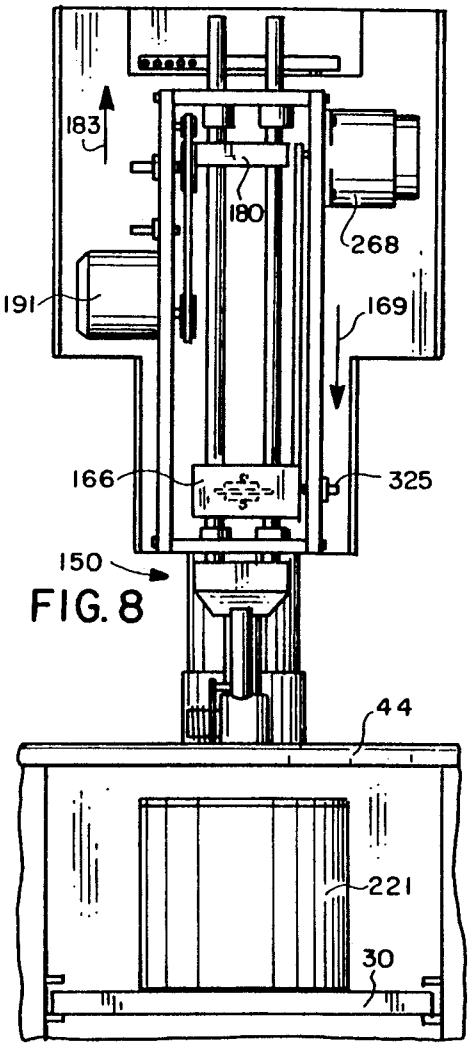
FIGS. 6–8 are fragmentary front elevational views of the apparatus showing a sequence of operation of the valve mechanism.
Figure 7:
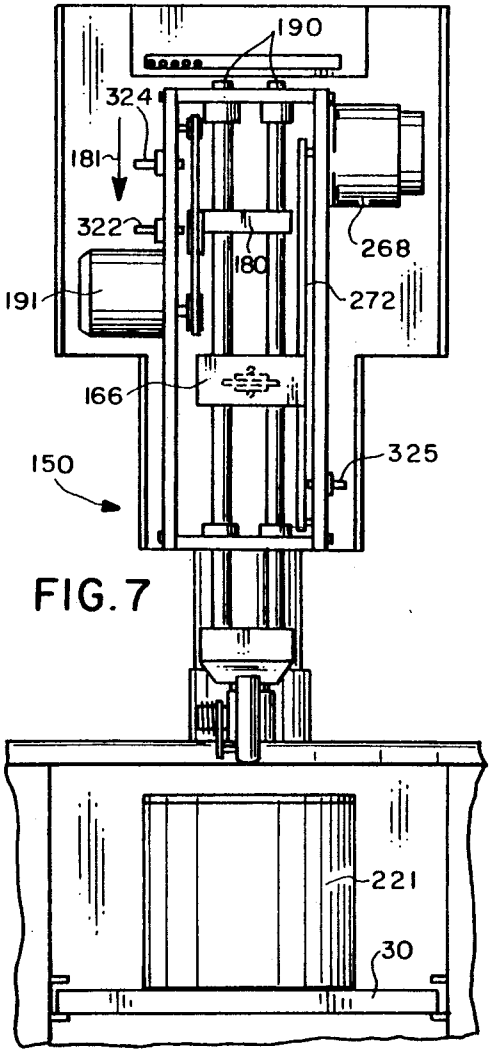

Referring briefly to FIGS. 6–8, FIG. 6 shows travelling held 166 being raised in the direction of arrow 167 to draw liquid colorant into the pump chamber presented to the actuating mechanism. The travelling head 180 is shown in a fully raised position detected by sensor 324, corresponding to a fully closed valve position. In FIG. 7, drive motor 191 is activated to move travelling head 180 in the downward direction of arrow 181 to an open valve position detected by the lower sensor 322. During the valve actuating operation, motor 268 is de-energized to lock cog belt 272 and travelling head 166 in a stationary position. With the valve open and the pump filled with a metered amount of colorant, motor 268 is energized so as to lower travelling head 166 in the downward direction of arrow 169, thereby discharging colorant into container 221 located below turntable 44. When travelling head 166 is fully lowered, corresponding to a complete discharge of the colorant pump (see FIG. 8), sensor 325 sends a signal indicating this condition to computer 18. Thereafter, motor 191 is energized to raise travelling head 180 in the upward direction of arrow 183, thus returning the valve to a fully closed position in preparation for an indexing of turntable 44 and a dispensing of another colorant from a different colorant dispenser assembly. Upon dispensing of all of the colorants required for a particular formulation, the paint container 221 is withdrawn from shelf 30 and a fresh container of paint base material is placed on the shelf, in preparation for another colorant dispensing operation.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following Claims.

What is claimed is

1. Dispenser actuating apparatus for actuating a dispenser pump and a shut off valve of an automated dispensing machine, the apparatus comprising:

a support structure;

elongated guide rail means having a longitudinal axis and a first end;

guide rail mounting means for slidably mounting the guide rail means on the support structure for movement along the longitudinal axis of the guide rail means;

valve engaging means carried at the first end of the guide rail means;

means for securing the valve engaging means to the guide rail means;

a drive block for axially displacing the guide rail means;

means for fixedly attaching the drive block to the guide rail means;

a pump engaging means for actuating a pump of the dispenser machine;

means for slidably mounting the pump engaging means on the guide rail means for sliding movement therealong;

means for moving the drive block in opposite directions generally parallel to the axis of the guide rail means to thereby reciprocate the guide rail means and the valve engaging means carried thereon for valve actuating movement without displacing the pump engaging means; and means for moving the pump engaging means in opposite directions along the guide rail means to thereby reciprocate the pump engaging means for pump actuating movement without displacing the valve engaging means.

2. The apparatus of claim 1 wherein the elongated guide rail means comprises a pair of spaced, generally parallel guide rails.

3. The apparatus of claim 2 wherein the support structure comprises a frame with upper and lower spaced ends and apertures in each end for receiving the guide rails.

4. The apparatus of claim 3 wherein the guide rail mounting means comprises bushing means for slidably receiving the guide rails.

5. The apparatus of claim 1 wherein the valve engaging means comprises a protruding bracket defining a generally horizontal slot for receiving part of the valve.

6. The apparatus of claim 1 wherein the pump engaging means comprises a pair of spaced rollers, one positioned above the other to form a pump-receiving nip therebetween.

7. The apparatus of claim 3 wherein the means for moving the drive block comprises a motor mounted in the frame, idler roller means spaced from the motor and mounted in the frame, a drive belt between the motor and idler roller, and means for attaching the drive belt to the drive block.

8. The apparatus of claim 3 wherein the means for moving the pump engaging means comprises a pump actuating motor mounted in the frame, idler roller means spaced from the pump actuating motor and mounted in the frame, a drive belt between the pump actuating motor and idler roller, and means for attaching the drive belt to the pump engaging means.

9. Dispenser actuating apparatus for actuating a dispenser pump and a shut off valve of an automated dispensing machine, the apparatus comprising:

a support structure including a frame;

slide means mounted in the frame including guide rail means elongated along an axis and having a first end, and the slide means further including a slide element mounted for sliding along the guide rail means;

guide rail mounting means for slidably mounting the guide rail means on the frame for movement along the longitudinal axis of the guide rail means;

a first actuator mounted on the guide rail means adjacent the first end thereof, for movement therewith;

means for fixedly attaching the first actuator to the guide rail means;

a drive block for axially displacing the guide rail means;

means for fixedly attaching the drive block to the guide rail means;

a second actuator mounted on the slide element;

means for moving the drive block in opposite directions generally parallel to the axis of the guide rail means to thereby reciprocate the guide rail means and the first actuator carried thereon without displacing the second actuator; and means for moving the sliding element in opposite directions along the guide rail means to thereby reciprocate the second actuator for independent actuating movement without displacing the guide rail means or the first actuator mounted thereon.

10. The apparatus of claim 9 wherein the elongated guide rail means comprises a pair of spaced, generally parallel guide rails.

11. The apparatus of claim 10 wherein the frame includes upper and lower spaced ends and apertures in each end for receiving the guide rails.

12. The apparatus of claim 11 wherein the guide rail mounting means comprises bushing means for slidably receiving the guide rails.

13. The apparatus of claim 9 wherein the first actuator comprises a protruding bracket defining a generally horizontal slot for receiving part of the valve.

14. The apparatus of claim 9 wherein the second actuator comprises a pair of spaced rollers, one positioned above the other to form a pump-receiving nip therebetween.

15. The apparatus of claim 11 wherein the means for moving the drive block comprises a motor mounted in the frame, idler roller means spaced from the motor and mounted in the frame, a drive belt between the motor and idler roller, and means for attaching the drive belt to the drive block.

16. The apparatus of claim 11 wherein the means for moving the sliding element comprises a pump actuating motor mounted in the frame, idler roller means spaced from the pump actuating motor and mounted in the frame, a drive belt between the pump actuating motor and idler roller, and means for attaching the drive belt to the sliding element.

* * * * *